United States Patent [19]

Moore

[11] 4,409,926

[45] Oct. 18, 1983

[54] HORIZONTAL SHEEL BOILER

[75] Inventor: John P. Moore, Gainsborough, England

[73] Assignee: Vosper Thornycroft Limited, Portsmouth, United Kingdom

[21] Appl. No.: 258,135

[22] Filed: Apr. 27, 1981

[30] Foreign Application Priority Data

Apr. 30, 1980 [GB] United Kingdom ..... 8014229

[51] Int. Cl.[3] ..... F23C 111/02

[52] U.S. Cl. ..... 122/4 D; 122/74; 122/136 R; 122/166 R; 122/182 R

[58] Field of Search ..... 122/4 D, 74, 47–49, 122/135 R, 135 F, 152, 153, 166 R, 182 R, 182 T

[56] References Cited

U.S. PATENT DOCUMENTS

| | | | |
|---|---|---|---|
| 54,730 | 5/1866 | Howell | 122/182 R |
| 414,168 | 10/1889 | Ranton | 122/74 |
| 479,648 | 7/1892 | Tester | 122/74 |
| 1,290,096 | 1/1919 | Cook | 122/166 R |
| 1,933,229 | 10/1933 | Stacey | 122/74 |
| 3,233,596 | 2/1966 | Gerbert | 122/136 R |
| 4,270,468 | 6/1981 | Robinson et al. | 122/4 D |
| 4,273,073 | 6/1981 | Robinson | 122/4 D |
| 4,308,826 | 1/1982 | Moore | 122/4 D |

FOREIGN PATENT DOCUMENTS

| | | | |
|---|---|---|---|
| 7113 | 7/1978 | European Pat. Off. | 122/49 |
| 1133257 | 11/1968 | United Kingdom . | |

*Primary Examiner*—Henry C. Yuen

*Attorney, Agent, or Firm*—Abelman, Frayne & Rezac

[57] ABSTRACT

A horizontal shell boiler has a horizontal furnace section which communicates with a flue gas transfer section at its end which transfers the flue gases from the furnace section to flue tubes extending horizontally through the space between the furnace section and the shell of the boiler. The furnace section is designed for fluidized bed combustion and has a flue gas transfer tube extending horizontally through its upper portion. The tube has hollow walls connected to the boiler fluid surrounding the furnace section and has apertures formed in its hollow wall through which furnace gases can enter the tube. The furnace gases after entering the flue gas transfer tube travel horizontally and do not entrain material of the fluidized bed.

4 Claims, 5 Drawing Figures

HORIZONTAL SHEEL BOILER

This invention relates to horizontal shell boilers and it is an object of this invention to provide a horizontal shell boiler.

According to this invention, there is provided a horizontal shell boiler comprising a shell intended to contain boiler fluid, a horizontal furnace section extending within the shell, flue gas tubes extending horizontally through the shell and disposed above and around the furnace section, a flue gas transfer section at one end of the furnace section for transferring the products of combustion from the furnace section to the said flue gas tubes, and flue gas transfer means extending horizontally through the upper portion of the furnace section and constituted by a flue gas tube, the wall of the flue gas transfer means being hollow and communicating through tubes with the space between the furnace section and the shell, passages being formed through the wall of the flue gas transfer means so that the interior of the flue gas transfer means is in communication with the space within the furnace section.

Preferably, the lower portion of the hollow wall of the flue gas transfer means is connected to the space between the furnace section and the shell by a plurality of inclined boiler fluid tubes and the upper portion of the hollow wall of the flue gas transfer means is connected to the space between the furnace section and the shell by a further plurality of boiler fluid tubes.

Preferably, the further plurality of boiler fluid tubes are vertical.

In a preferred embodiment of the invention, the lower portion of the wall of the flue gas transfer means is connected to the space between the furnace section and the shell by two rows of boiler fluid tubes extending on opposite sides of the vertical plane of symmetry of the horizontal furnace section.

Preferably, there are provided a plurality of boiler fluid tubes extending through the furnace section and each having a portion extending substantially vertically and between two adjacent inclined boiler fluid tubes and communicating at each end with the space between the furnace section and the said shell.

In use, the combustion or flue gases leave the burning fuel vertically and enter the tube constituting the flue gas transfer means along which they travel horizontally until they reach the flue gas transfer section. This is an advantageous arrangement where the furnace section is designed for fluidized bed combustion, as if the gases were constrained to enter the transfer section at the end of the furnace section by moving horizontally immediately above the level of the fluidised bed, then due to the increasing volume of combustion gases moving horizontally as the transfer section is approached, a corresponding increase in the horizontal velocity would occur. This horizontal velocity could increase to the point where it would cause entrainment of the fluidised bed material in a horizontal direction and cause a substantial amount of bed material to be deposited in the transfer section. In the horizontal shell boiler in accordance with this invention in which the horizontal motion of the combustion gases substantially takes place within the flue gas transfer means, there is little likelihood of entrainment of the bed material.

The feature that the flue gas transfer means is in the form of a tube having a hollow shell intended to contain boiler fluid increases the heat transfer to the boiler fluid and each boiler fluid tube within the furnace section increases heat transfer to the boiler fluid, which is, of course, advantageous.

A horizontal shell boiler in accordance with this invention will now be described, by way of example only, with reference to the accompanying drawings, of which:

Figure 1:
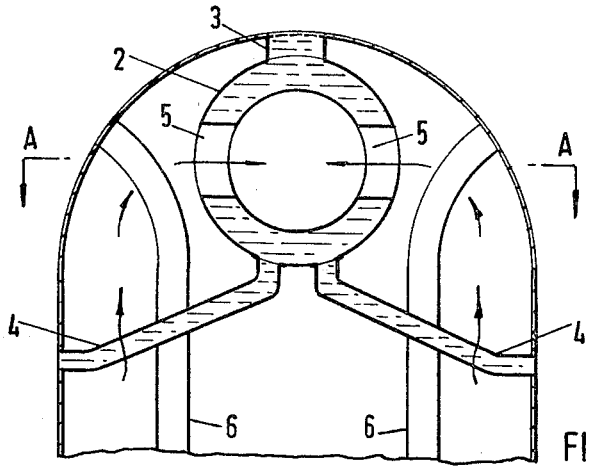
FIG. 1 is a partial end view of the furnace section of a horizontal shell boiler in accordance with this invention.
Figure 2:
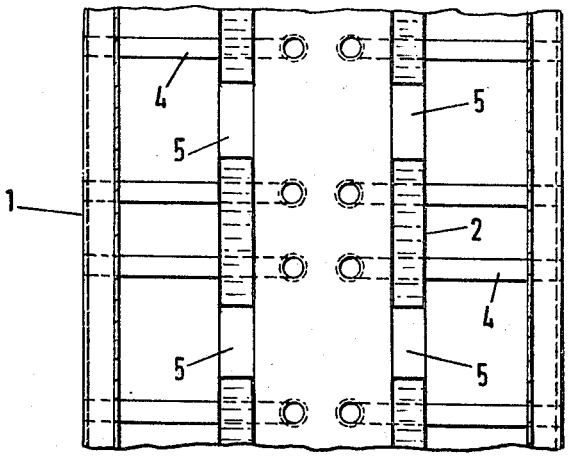
FIG. 2 is a horizontal section on line A—A of FIG. 1 without showing the generally vertical water tubes shown in FIG. 1.
Figure 3:
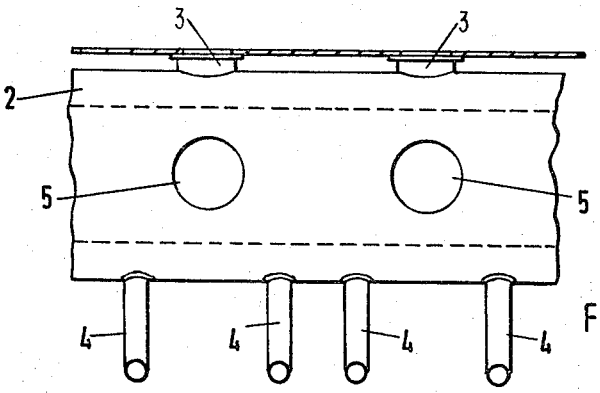
FIG. 3 is a partial vertical section along the vertical axis of symmetry of the furnace section.

Referring to the drawings, a horizontal shell boiler has a furnace section 1 and a flue gas transfer section at its end which transfers the flue gases from the furnace section 1 to the flue tubes extending horizontally through the space between the furnace section and the shell of the boiler.

The furnace section 1 is open at its bottom end and is designed for fluidized bed combustion and has a tube 2 extending horizontally through it in its upper portion. The tube 2 has a hollow wall connected at its upper end by a plurality of short connecting tubes 3 to the space in the shell immediately above the furnace section 1 and connected at its bottom by two sets of inclined water tubes 4 to the space between the furnace section 1 and the shell. Along each side, the tube 2 has a series of horizontally extending apertures 5 in its wall through which furnace gases can enter the tube 2.

Between each pair of adjacent water tubes 4 a plurality of water tubes 6 extends vertically, each tube 6 being connected at each end to the boiler water surrounding the furnace section 1 by integral portions which are at least 45° to the vertical.

Figure 4:
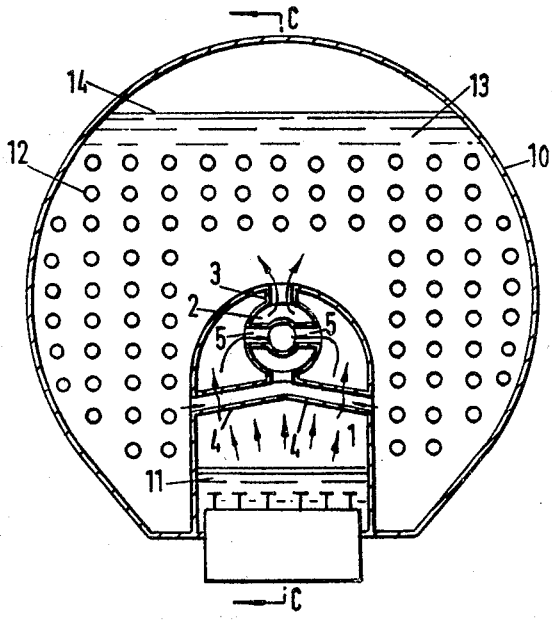
FIGS. 4 and 5 are, respectively, a transverse vertical section and a longitudinal section of the whole horizontal shell boiler, FIG. 4 being taken on line B—B of FIG. 5 and FIG. 5 on line C—C of FIG. 4.
Figure 5:
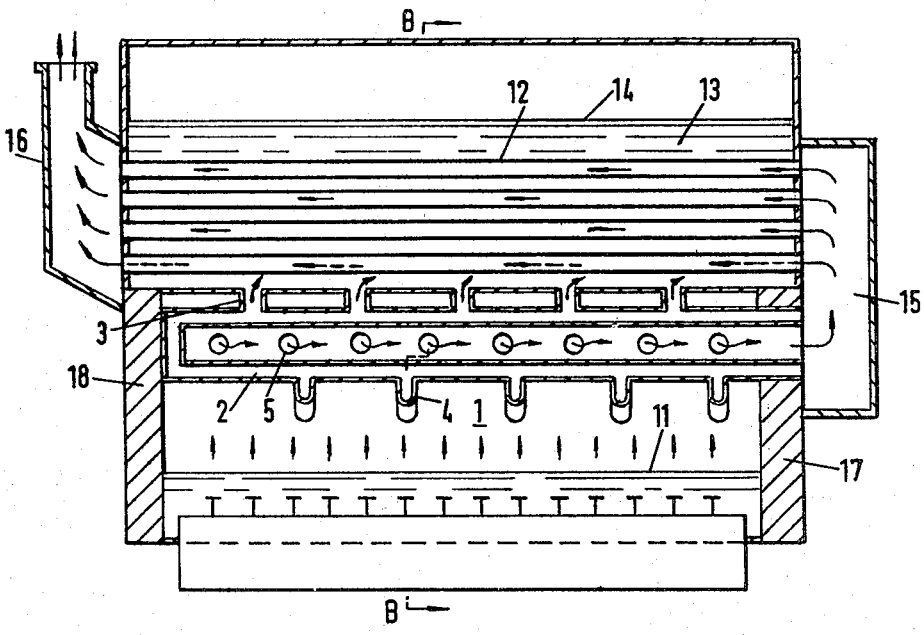

The arrows in FIGS. 4 and 5 show the directions of fluid flow.

The horizontal shell boiler as a whole is shown in FIGS. 4 and 5 and has a cylindrical shell 10 in the base of which the longitudinally extending furnace section 1 is formed. The fluidized bed is denoted at 11. Flue gas tubes 12 extend horizontally above and around the furnace section 1 through the space between the shell 10 and the furnace section 1. This space contains water 13 the level of which is denoted at 14. At one end the tube 2 communicates with a flue gas transfer section 15 with which one end of each flue gas tube 12 communicates. The other end of the flue gas tube communicates with a chimney 16. For the sake of simplicity, FIGS. 4 and 5 do not show the water tubes 6.

In use, the combustion gases leave the fluidised bed 11 vertically and pass between the tubes 6 and between the inclined water tubes 4 and enter the tube 2 by passing through the horizontal apertures 5. Once in the tube 2, the combustion gases travel horizontally and accelerate as they approach the flue gas transfer section. Only the interior of the tube 2 communicates with the flue gas transfer section as that interior communicates with an aperture in a refractory door 17 (FIG. 5) which closes the end of the furnace section 1 and which separates the furnace section 1 from the flue gas transfer section 15.

The other end of the furnace section 1 is closed by a refractory door 18.

The provision of the tubes 3, 4 and 6, all of which contain boiler water 13 and the provision of the tube 2, the wall of which contains boiler water 13, all within the furnace section 1 increases heat transfer to the boiler water 13, which is advantageous. The space above the water level 14 contains steam.

I claim:

1. In a horizontal shell boiler with fluidized bed combustion of the type comprising a shell intended to contain boiler fluid, a horizontal furnace section extending within the shell, flue gas tubes extending horizontally through the shell and disposed above and around the furnace section, and a flue gas transfer section at one end of the furnace section for transferring the products of combustion from the furnace section to the said flue gas tubes (, and); the improvement comprising:

flue gas transfer means extending horizontally (through) within an upper portion of the furnace section, (said fluid gas transfer means comprising:) and which includes;

a double-walled flue gas tube defining a jacket and an inner flue gas transfer passage;

boiler fluid transfer passages communicating the interior of said jacket with the interior of said boiler shell, including a first plurality of said boiler fluid transfer passages which are inclined to the horizontal and which connect a lower portion of said jacket, and a second plurality of said boiler fluid transfer passages which connect an upper portion of said jacket with the interior of said boiler shell; and horizontally oriented, flue gas transfer passages extending through both of said walls of said double-walled flue gas tube(,) and spaced longitudinally thereof, said passages communicating said inner flue gas transfer passage with the interior of said furnace section.

2. The horizontal shell boiler of claim 1, wherein said second plurality of boiler fluid transfer passages are vertical.

3. The horizontal shell boiler of claim 1 wherein said first plurality of boiler fluid transfer passages are arranged in two rows extending on opposite sides of a vertical plane of symmetry of the horizontal furnace section.

4. The horizontal shell boiler of claim 1, further including a third plurality of boiler fluid transfer passages extending through the horizontal furnace section and each having a portion extending substantially vertically and between two adjacent inclined boiler fluid tubes, said third plurality of boiler fluid transfer passages communicating at each end with the interior of said boiler shell.

* * * * *

UNITED STATES PATENT AND TRADEMARK OFFICE

CERTIFICATE OF CORRECTION

PATENT NO. : 4,409,926

DATED : October 18, 1983

INVENTOR(S) : John P. MOORE

It is certified that error appears in the above-identified patent and that said Letters Patent is hereby corrected as shown below:

In the Title

Change "SHEEL" to --SHELL--.

Signed and Sealed this

*Seventeenth* Day of *January 1984*

[SEAL]

*Attest:*

GERALD J. MOSSINGHOFF

*Attesting Officer*

*Commissioner of Patents and Trademarks*